US011512657B2

(12) United States Patent
Inoue

(10) Patent No.: US 11,512,657 B2
(45) Date of Patent: Nov. 29, 2022

(54) OUTBOARD MOTOR AND CONTROL METHOD FOR OUTBOARD MOTOR

(71) Applicant: YAMAHA HATSUDOKI KABUSHIKI KAISHA, Iwata (JP)

(72) Inventor: Hiroshi Inoue, Iwata (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 735 days.

(21) Appl. No.: 16/527,824

(22) Filed: Jul. 31, 2019

(65) Prior Publication Data

US 2020/0300191 A1 Sep. 24, 2020

(30) Foreign Application Priority Data

Mar. 19, 2019 (JP) ..... JP2019-051218

(51) Int. Cl.

| | |
|---|---|
| ***F02D 41/06*** | (2006.01) |
| ***B63H 20/14*** | (2006.01) |
| ***F02B 61/04*** | (2006.01) |
| ***B63J 99/00*** | (2009.01) |
| ***B63B 79/00*** | (2020.01) |

(52) U.S. Cl.

CPC ..... *F02D 41/064* (2013.01); *B63H 20/14* (2013.01); *B63J 99/00* (2013.01); *F02B 61/045* (2013.01); *B63B 79/00* (2020.01)

(58) Field of Classification Search

CPC ..... F02D 41/064; B63H 20/14; B63J 99/00; F02B 61/045; B63B 79/00

See application file for complete search history.

(56) References Cited

U.S. PATENT DOCUMENTS

| | | | | |
|---|---|---|---|---|
| 4,541,390 | A * | 9/1985 | Steinbrenner | F02D 41/064 123/478 |
| 8,740,661 | B2 | 6/2014 | Inoue | |
| 10,059,417 | B1 * | 8/2018 | Hilbert | F02N 11/08 |
| 2014/0277881 | A1 * | 9/2014 | Okubo | B60W 10/08 180/65.28 |

FOREIGN PATENT DOCUMENTS

| | | | |
|---|---|---|---|
| JP | 2012232681 | A | 11/2012 |

* cited by examiner

*Primary Examiner* — Stephen P Avila
(74) *Attorney, Agent, or Firm* — Rabin & Berdo, P.C.

(57) ABSTRACT

A controller performs hydrolock prevention control when an engine is started. The controller determines whether a crankshaft rotates a predetermined number of times upon starting the engine without ignition of the engine. The controller performs the ignition of the engine after the crankshaft rotates a predetermined number of times.

18 Claims, 5 Drawing Sheets

OUTBOARD MOTOR AND CONTROL METHOD FOR OUTBOARD MOTOR

BACKGROUND

Field of the Invention

The present disclosure relates to an outboard motor and a control method for the outboard motor.

Background Information

In an outboard motor, water may enter the cylinder of the engine through the exhaust passage. For example, Japanese Patent Application Laid-Open No. 2012-232681 describes that when the shift lever is switched to a reverse position during high-speed cruise, water enters the cylinder by reverse rotation of the engine.

SUMMARY

Water may also enter the cylinder of the engine through the exhaust passage when the engine is stopped. For example, with the outboard motor at full tilt down, the rear end of the outboard motor may be submerged in water when the boat is lowered from the ramp. In that case, water may enter the cylinder of the engine. In that state, when the engine is started, the hydrolock may damage the engine.

An object of the present disclosure is to prevent damage to an engine due to a hydrolock at engine start-up in an outboard motor.

An outboard motor according to a first aspect comprises an engine and a controller. The engine includes a cylinder and a crankshaft. The controller performs hydrolock prevention control upon starting the engine. The controller executes the following processing in the hydrolock prevention control. The controller determines whether the crankshaft rotates a predetermined number of times without ignition of the engine upon starting the engine. The controller performs the ignition of the engine after the crankshaft rotates a predetermined number of times.

A control method for an outboard motor according to a second aspect comprises performing hydrolock prevention control upon starting an engine. The hydrolock prevention control includes the following processing. The first process is to determine whether a crankshaft rotates a predetermined number of times without ignition of the engine upon starting the engine. The second process is to perform the ignition of the engine after the crankshaft rotates a predetermined number of times.

DETAILED DESCRIPTION OF EMBODIMENTS

Figure 1:
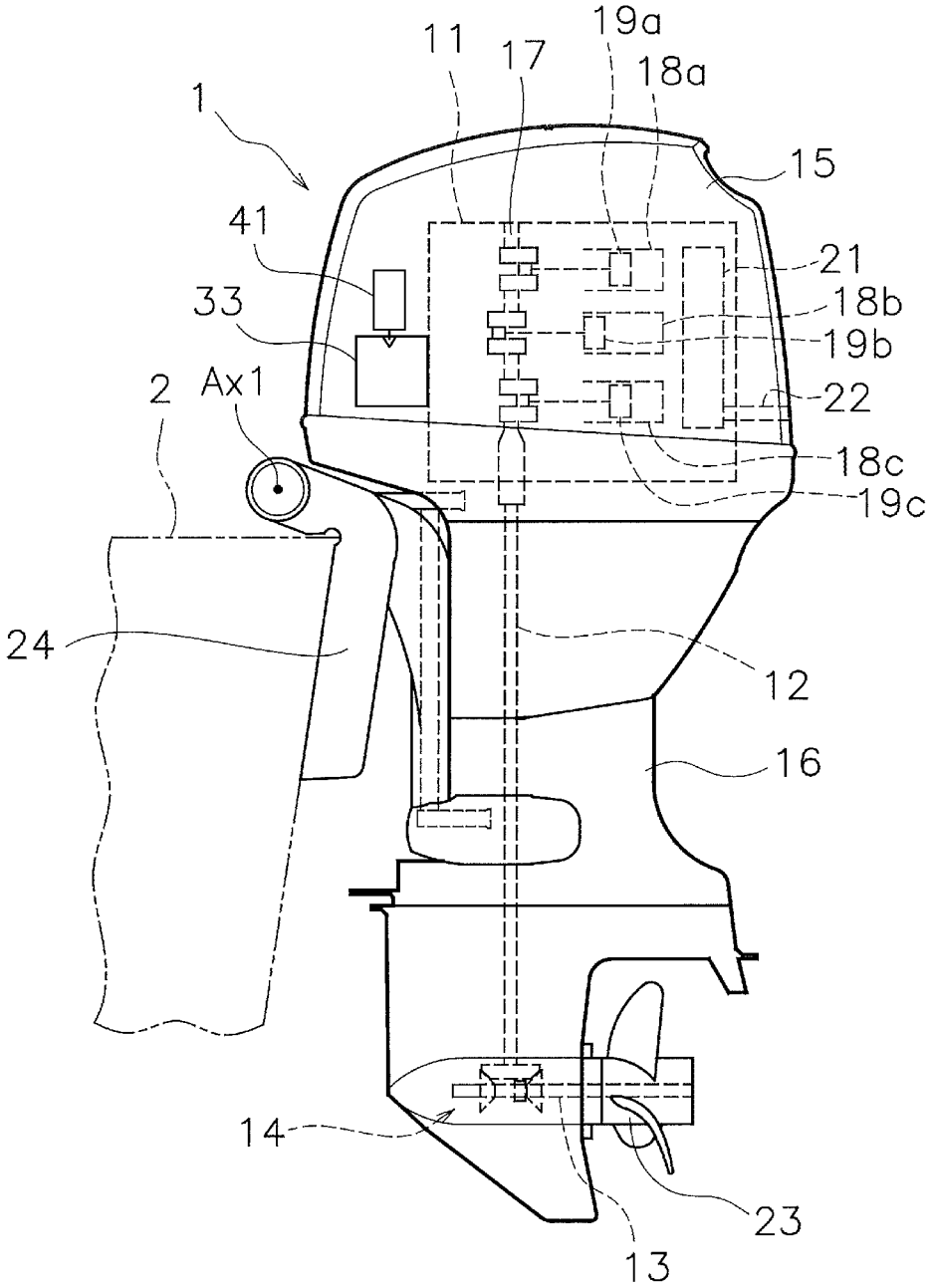
FIG. 1 is a side view of an outboard motor according to an embodiment.

Hereinafter, embodiments will be described with reference to the drawings. FIG. 1 is a side view of the outboard motor 1 according to the embodiment. The outboard motor 1 is attached to the stern of the boat 2. As shown in FIG. 1, the outboard motor 1 includes an engine 11, a drive shaft 12, a propeller shaft 13, a shift mechanism 14, an engine cover 15, and a housing 16. The engine 11 generates a propulsive force for propelling the boat 2. The engine 11 is disposed in an engine cover 15.

The engine 11 includes a crankshaft 17, cylinders 18*a*-18*c*, and pistons 19*a*-19*c*. The crankshaft 17 extends in the vertical direction. The drive shaft 12 is connected to the crankshaft 17. The drive shaft 12 extends in the vertical direction. The pistons 19*a*-19*c* are connected to the crankshaft 17. The pistons 19*a*-19*c* are disposed in the cylinders 18*a*-18*c*, respectively. In FIG. 1, the engine 11 includes three cylinders 18*a*-18*c*. However, the number of cylinders is not limited to three, may be less than three, or may be more than three.

The engine 11 includes an exhaust manifold 21 and an exhaust passage 22. The exhaust manifold 21 is connected to the exhaust ports of the cylinders 18*a*-18*c*. The exhaust passage 22 is connected to the exhaust manifold 21. The outlet of the exhaust passage 22 is provided on the engine cover 15. However, the outlet of the exhaust passage 22 may be provided at another place such as the housing 16. Exhaust gas from the engine 11 is exhausted to the outside of the outboard motor 1 through the exhaust manifold 21 and the exhaust passage 22.

The propeller shaft 13 extends in the front-rear direction. The propeller shaft 13 is connected to the drive shaft 12 via the shift mechanism 14. A propeller 23 is connected to the propeller shaft 13. The housing 16 is disposed below the engine cover 15. The drive shaft 12, the propeller shaft 13 and the shift mechanism 14 are disposed in the housing 16. The shift mechanism 14 switches the rotational direction of the power transmitted from the drive shaft 12 to the propeller shaft 13 between the forward direction and the reverse direction. The shift mechanism 14 includes, for example, a plurality of gears and a clutch that changes the meshing of the gears.

Figure 2:
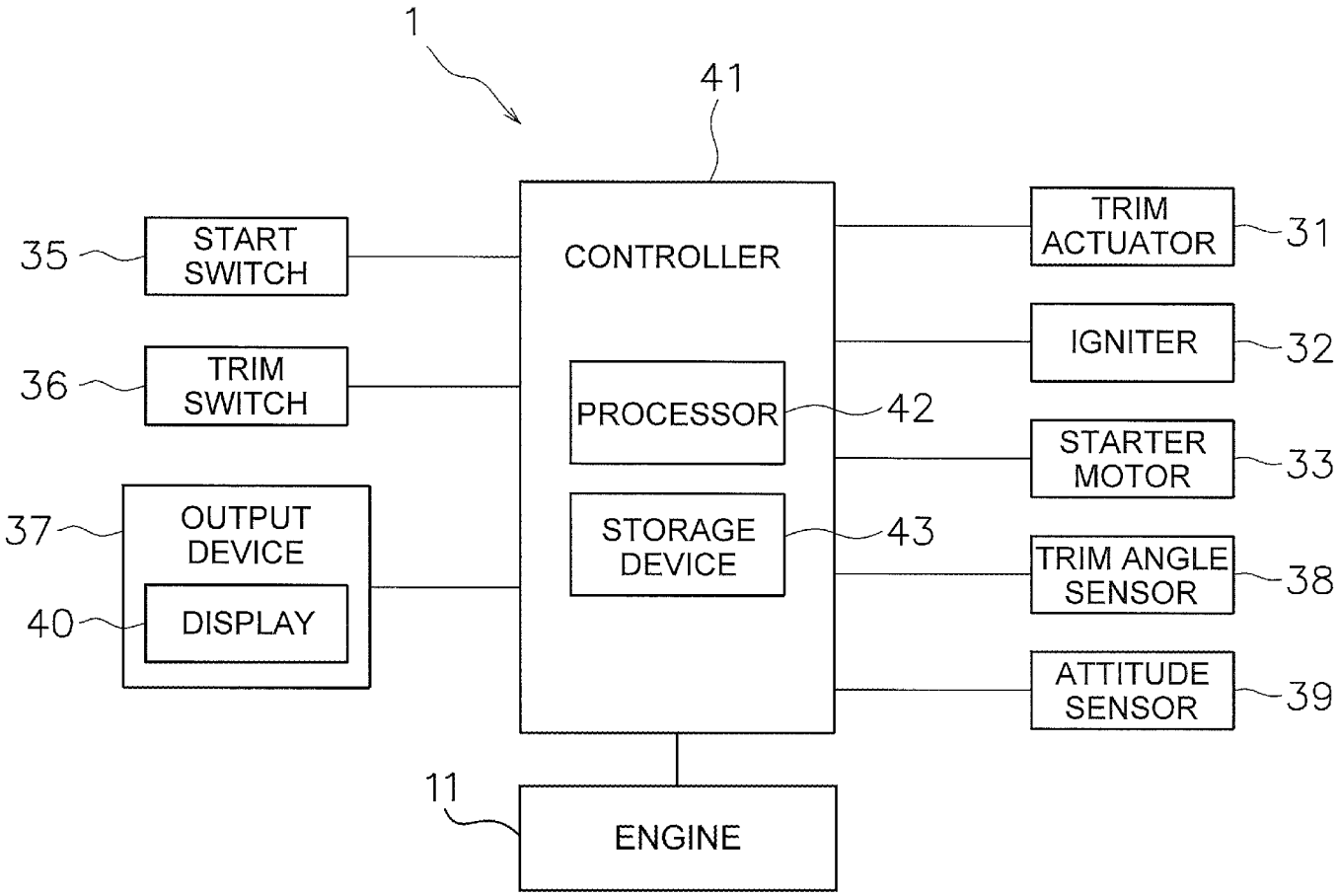
FIG. 2 is a block diagram showing the configuration of the outboard motor.

The outboard motor 1 includes a bracket 24. The bracket 24 is attached to the stern of the boat 2. The bracket 24 rotatably supports the outboard motor 1 about the trim axis Ax1. FIG. 2 is a block diagram showing the configuration of the outboard motor 1. As shown in FIG. 2, the outboard motor 1 includes a trim actuator 31. The trim actuator 31 swings the outboard motor 1 up and down around the trim axis Ax1. The trim actuator 31 includes, for example, a hydraulic cylinder. However, the trim actuator 31 may include other devices such as an electric cylinder or an electric motor.

The engine 11 includes an igniter 32 and a starter motor 33. The igniter 32 ignites the air-fuel mixture in the combustion chamber of the engine 11. The igniter 32 includes, for example, an ignition coil and a spark plug. The starter motor 33 starts the engine 11 by rotating the crankshaft 17.

As shown in FIG. 2, the outboard motor 1 includes a controller 41. The controller 41 includes a processor 42 and a storage device 43. The storage device 43 includes volatile memory such as RAM and non-volatile memory such as ROM. The storage device 43 may include an auxiliary storage device such as an SSD or an HDD. The storage device 43 stores programs and data for controlling the outboard motor 1. The processor 42 is, for example, a CPU (Central Processing Unit). The processor 42 executes a process for controlling the outboard motor 1 according to the program.

The outboard motor 1 includes a start switch 35 and a trim switch 36. The controller 41 is communicably connected to the start switch 35 and the trim switch 36. When the controller 41 receives the on-signal from the start switch 35, the controller 41 controls the starter motor 33 and the igniter 32 to start the engine 11. The start switch 35 may be disposed outside the outboard motor 1. Alternatively, the start switch 35 may be attached to the outboard motor 1.

The trim switch 36 is a switch for swinging the outboard motor 1 up and down around the trim axis Ax1. The controller 41 controls the trim actuator 31 to raise or lower the outboard motor 1 according to the operation signal from the trim switch 36. The trim switch 36 may be disposed outside the outboard motor 1. Alternatively, the trim switch 36 may be attached to the outboard motor 1.

The outboard motor 1 includes a trim angle sensor 38 and an attitude sensor 39. The trim angle sensor 38 detects a trim angle of the outboard motor 1. The trim angle is an angle of the outboard motor based on the position of the lowest point around the trim axis Ax1. As the lower end of the outboard motor 1 rises with respect to the boat 2, the trim angle is increased. The trim angle sensor 38 is attached to the bracket 24, for example. However, the trim angle sensor 38 may be disposed at a place other than the bracket 24. The trim angle sensor 38 is, for example, a potentiometer. However, the trim angle sensor 38 may be an optical sensor or another sensor such as a magnetic sensor.

The attitude sensor 39 detects the attitude angle of the boat 2. The attitude angle is an inclination angle of the boat 2 in the front-rear direction with respect to the horizontal direction. The attitude sensor 39 is attached to the boat 2. The attitude sensor 39 is, for example, a gyro sensor. However, the attitude sensor 39 may be another sensor such as an acceleration sensor. The controller 41 is communicably connected to the trim angle sensor 38 and the attitude sensor 39. The controller 41 receives a signal indicative of the trim angle from the trim angle sensor 38. The controller 41 receives a signal indicative of an attitude angle from the attitude sensor 39.

The controller 41 is communicably connected to an output device 37. The output device 37 is controlled by the controller 41. The output device 37 includes a display 40. The display 40 displays a screen according to the signal from the controller 41. The output device 37 may include a speaker. The output device 37 may include a touch panel.

Figure 3:
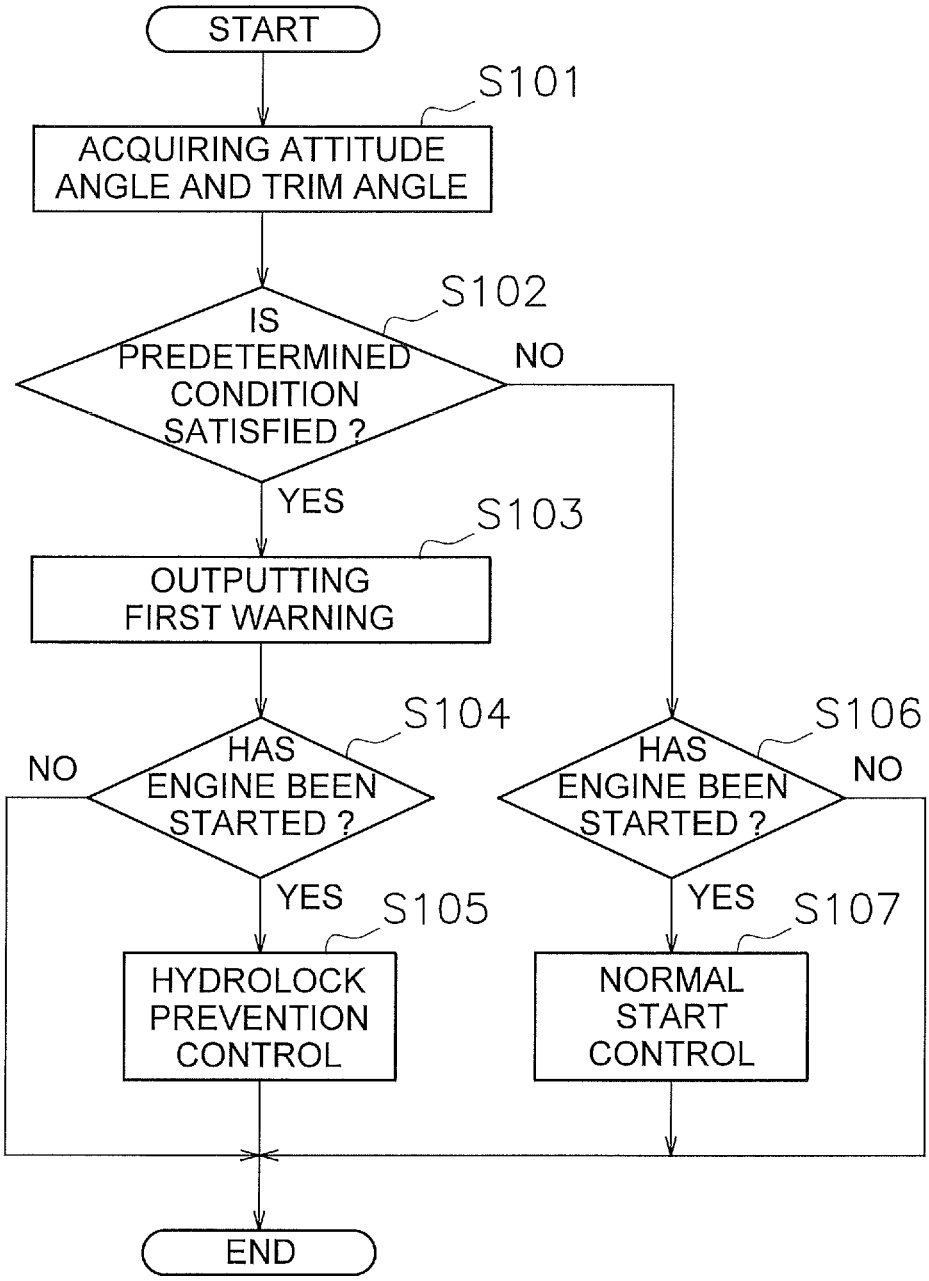
FIG. 3 is a flowchart showing processing executed by a controller when a system of the outboard motor is started.

FIG. 3 is a flowchart showing processing executed by the controller 41 when the system of the outboard motor 1 is started. As shown in FIG. 3, in step S101, the controller 41 acquires the attitude angle and the trim angle. The controller 41 acquires an attitude angle based on a signal from the attitude sensor 39. The controller 41 acquires a trim angle based on a signal from the trim angle sensor 38.

Figure 4:
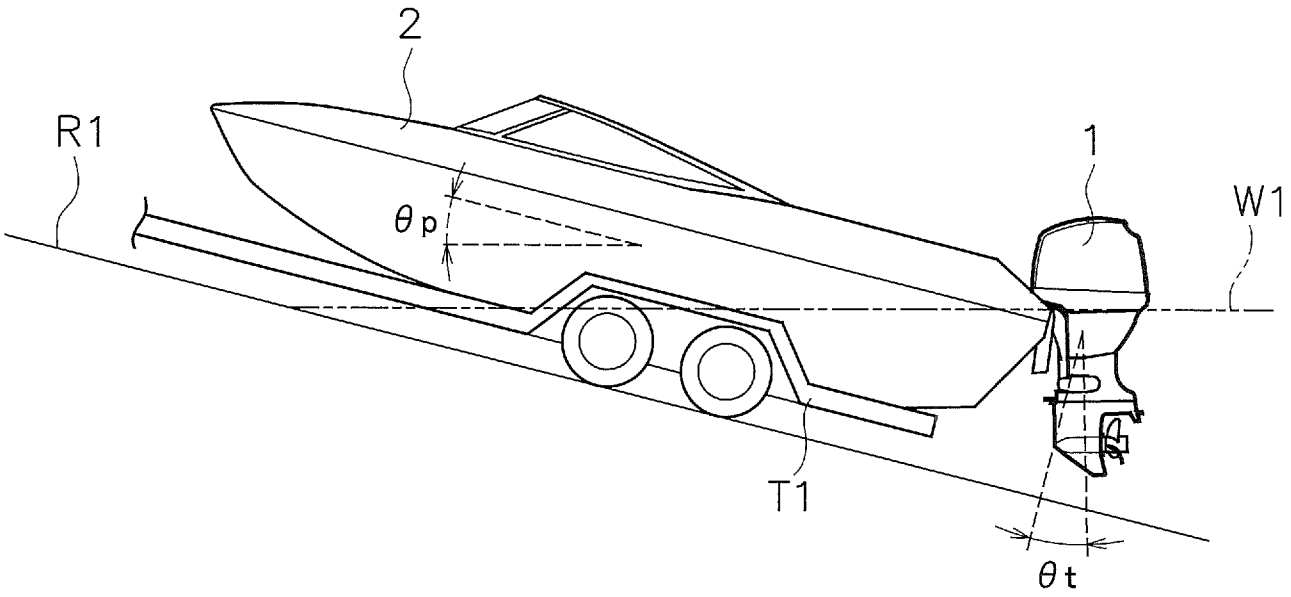
FIG. 4 is a view showing an example of a boat on a trailer at a boat ramp.

In step S102, the controller 41 determines whether a predetermined condition is satisfied. The predetermined conditions indicate the possibility of water entering the cylinders 18*a*-18*c*. Specifically, the predetermined condition includes that the trim angle is equal to or less than a first angle threshold (first condition). The first angle threshold is preferably a trim angle assumed when the outlet of the exhaust passage 22 is highly likely to be located below the water surface. FIG. 4 is a view showing an example of the boat 2 on the trailer T1 in the boat ramp R1. As shown in FIG. 4, when the trim angle θt is larger than the first angle threshold, the outlet of the exhaust passage 22 described above is located above the water surface W1. When the trim angle θt is equal to or less than the first angle threshold, the outlet of the exhaust passage 22 described above is located below the water surface W1.

The first angle threshold may be changed according to the attitude angle θp. For example, the first angle threshold may be smaller as the attitude angle θp is smaller. The predetermined condition may include that the attitude angle θp is equal to or greater than a second angle threshold (second condition). The second angle threshold is preferably an attitude angle θp assumed when the outlet of the exhaust passage 22 is highly likely to be located below the water surface W1. The predetermined condition may be to satisfy both the first condition and the second condition. Alternatively, the predetermined condition may be to satisfy at least one of the first condition and the second condition.

If the predetermined condition is satisfied, the process proceeds to step S103. In step S103, the controller 41 causes the display 40 to output a first warning. The first warning is, for example, a display for prompting the user to start up the engine 11 after trimming up the outboard motor 1. Alternatively, the first warning may be an error code or another indication such as an icon. Alternatively, the first warning may be a warning sound or an audio prompting a warning.

In step S104, the controller 41 determines whether the engine 11 has been started. When the start switch 35 is operated and the starter motor 33 is driven, the controller 41 determines that the engine 11 has been started. When the engine 11 has been started, the controller 41 performs hydrolock prevention control in step S105. That is, the controller 41 performs the hydrolock prevention control upon starting the engine 11 in a state where the predetermined condition is satisfied.

Figure 5:
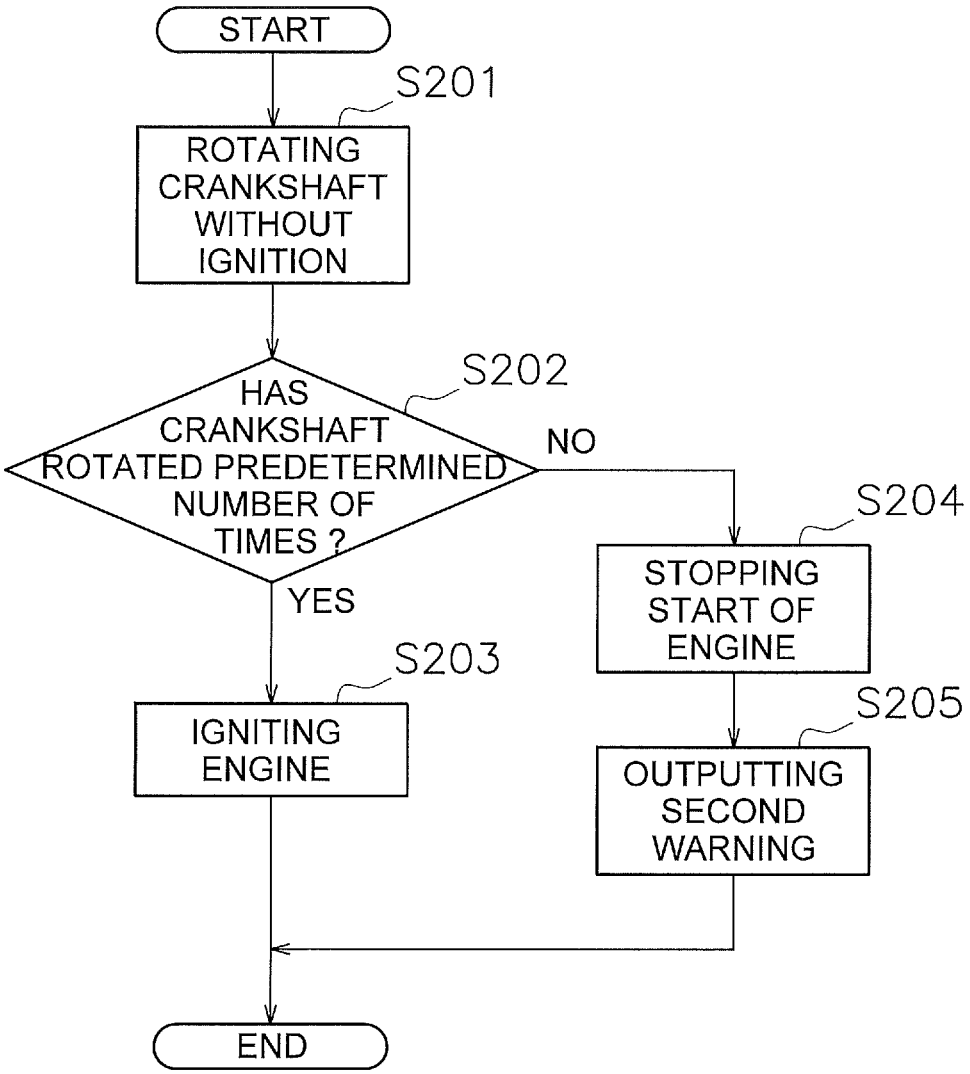
FIG. 5 is a flowchart showing the process of the hydrolock prevention control.

FIG. 5 is a flowchart showing the process of the hydrolock prevention control. As shown in FIG. 5, in step S201, the controller 41 rotates the crankshaft 17 without ignition of the engine 11 upon starting the engine 11. The controller 41 causes the starter motor 33 to rotate the crankshaft 17.

In step S202, the controller 41 determines whether the crankshaft 17 rotates a predetermined number of times. The predetermined number of times is, for example, two times. However, the predetermined number of times may be less than two times or more than two times. When the crankshaft 17 has rotated the predetermined number of times, the controller 41 ignites the engine 11 in step S203.

In step S202, when the crankshaft 17 is stopped without rotating for the predetermined number of times, the process proceeds to step S204. In step S204, the controller 41 stops the start of the engine 11 without ignition of the engine 11. Note that, in step S202, the controller 41 may determine whether the rotation has been performed the predetermined number of times within a predetermined time. When it is determined in step S202 that the rotation has not been performed the predetermined number of times within the predetermined time, the process may proceed to step S204.

Then, in step S205, the controller 41 causes the display 40 to output a second warning. The second warning includes, for example, a display including a description of the recovery process of the engine 11. The description display of the recovery process is, for example, a display showing a method of discharging water from the cylinders 18*a*-18*c*. The second warning may include an indication to indicate the water entering the cylinders 18*a*-18*c*. Alternatively, the second warning may be an error code or another indication such as an icon. Alternatively, the second warning may be a warning sound or an audio prompting a warning.

In step S102 shown in FIG. 3, when the predetermined condition is not satisfied, the process proceeds to step S106.

In step S106, the controller 41 determines whether the engine 11 has been started. When the engine 11 has been started, the controller 41 performs the normal start control in step S107. For example, in the normal start control, the controller 41 ignites the engine 11 without determining the rotation of the crankshaft 17 in step 202 described above.

In the outboard motor 1 according to the present embodiment described above, when the engine 11 has been started, it is determined whether the crankshaft 17 rotates a predetermined number of times without ignition of the engine 11. Then, after the crankshaft 17 rotates a predetermined number of times, ignition of the engine 11 is performed. Therefore, when the crankshaft 17 does not rotate for the predetermined number of times due to water entering the cylinders 18*a*-18*c*, the ignition of the engine 11 is not performed. Thus, damage to the engine 11 due to the hydrolock can be prevented.

Although the embodiments of the present disclosure have been described so far, the present invention is not limited to the above embodiments and various modifications may be made within the scope of the invention. The configuration of the outboard motor 1 may be changed. For example, the output device 37 may not include the display 40. The output device 37 may include other devices such as a warning light. The trim actuator 31 may be omitted. In that case, the outboard motor 1 may be capable of manual trimming operation.

The processing by the controller 41 described above may be changed. For example, the order of processing is not limited to that of the above embodiment and may be changed. Some of the processing may be omitted. The predetermined conditions indicative of the possibility of water entering the cylinders 18*a*-18*c* may be varied. For example, a signal from a sensor that detects the presence of water in the exhaust passage 22 may determine the possibility of water entering the cylinders 18*a*-18*c*.

What is claimed is:

1. An outboard motor comprising:
an engine including a cylinder and a crankshaft;
a controller configured to perform hydrolock prevention control upon starting the engine; and
an output device controlled by the controller, wherein
the controller is configured to:
upon starting the engine, determine whether the crankshaft rotates a predetermined number of times without igniting the engine by the controller, and
perform ignition of the engine after the crankshaft has rotated the predetermined number of times; and
in the hydrolock prevention control, the controller is further configured to cause the output device to output a predetermined warning without performing the ignition of the engine when the crankshaft stops before rotating the predetermined number of times.

2. The outboard motor according to claim 1, wherein the output device includes a display, and
the predetermined warning includes a description of a recovery process of the engine displayed on the display.

3. The outboard motor according to claim 2, wherein the description of the recovery process of the engine is a description of a method of discharging water from the cylinder of the engine.

4. The outboard motor according to claim 1, wherein the controller is further configured to not perform the ignition of the engine when the crankshaft does not rotate for the predetermined number of times within a predetermined time.

5. The outboard motor according to claim 1, further comprises:
a sensor for detecting a predetermined condition indicative of possibility of water entering the cylinder,
wherein the controller is further configured to perform the hydrolock prevention control when the predetermined condition is detected.

6. The outboard motor according to claim 5, wherein the sensor includes an attitude sensor that detects an attitude of a boat to which the outboard motor is attached, and
the predetermined condition includes an inclination angle of the boat with respect to a horizontal direction being equal to or greater than a predetermined angle threshold.

7. The outboard motor according to claim 5, wherein the sensor includes a trim angle sensor that detects a trim angle of the outboard motor, and
the predetermined condition includes the trim angle being equal to or less than a predetermined angle threshold.

8. The outboard motor according to claim 5, wherein the sensor includes an attitude sensor that detects an attitude of the outboard motor, and
the predetermined condition includes a condition related to the attitude of the outboard motor detected by the attitude sensor.

9. The outboard motor according to claim 8, wherein the attitude of the outboard motor is detected based on an attitude of a boat and a trim angle of the outboard motor.

10. A control method for an outboard motor, the control method comprising:
performing hydrolock prevention control, including:
upon starting an engine, determining whether a crankshaft rotates a predetermined number of times without the engine;
performing ignition of the engine after the crankshaft rotates the predetermined number of times; and
causing an output device to output a predetermined warning without performing the ignition of the engine when the crankshaft stops prior to rotating the predetermined number of times.

11. The control method for an outboard motor according to claim 10, wherein the output device includes a display, and
the predetermined warning includes a description of a recovery process of the engine displayed on the display.

12. The control method of the outboard motor according to claim 11, wherein the description of the recovery process of the engine is a description of a method of discharging water from a cylinder of the engine.

13. The control method for an outboard motor according to claim 10, wherein the hydrolock prevention control includes not performing the ignition of the engine when the crankshaft does not rotate for predetermined number of times within a predetermined time.

14. A control method for an outboard motor, the control method comprising:
detecting a predetermined condition indicative of possibility of water entering a cylinder; and
performing hydrolock prevention control, including:
upon starting an engine, determining whether a crankshaft rotates a predetermined number of times without ignition of the engine, and
performing the ignition of the engine after the crankshaft rotates the predetermined number of times, wherein
the hydrolock prevention control is performed when the predetermined condition is detected.

15. The control method for an outboard motor according to claim 14, wherein the predetermined condition includes an inclination angle with respect to a horizontal direction of a boat to which the outboard motor is attached being equal to or greater than a predetermined angle threshold.

16. The control method for an outboard motor according to claim 14, wherein the predetermined condition includes a trim angle of the outboard motor being equal to or greater than a predetermined angle threshold.

17. The control method for an outboard motor according to claim 14, wherein the predetermined condition includes a condition related to an attitude of the outboard motor.

18. The control method for an outboard motor according to claim 17, wherein the attitude of the outboard motor is detected based on an attitude of a boat and a trim angle of the outboard motor.

* * * * *